US006471812B1

(12) United States Patent
Thompson et al.

(10) Patent No.: US 6,471,812 B1
(45) Date of Patent: Oct. 29, 2002

(54) REDUCING HUMPING OF ROOFING SHINGLES

(75) Inventors: Thomas Kent Thompson, Granville, OH (US); David Brian Ollett, Pickerington, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/390,488

(22) Filed: Sep. 3, 1999

(51) Int. Cl.[7] ..... B32B 31/00

(52) U.S. Cl. ..... 156/242; 156/257; 156/260; 156/264; 156/512; 264/241; 264/293; 264/322

(58) Field of Search ..... 264/241, 257, 264/293, 322; 52/518, 553; 156/260, 264, 512, 542, 257

(56) References Cited

U.S. PATENT DOCUMENTS

| | | | | |
|---|---|---|---|---|
| 1,534,165 A | | 4/1925 | Cumfer | |
| 3,247,631 A | | 4/1966 | Lovness | |
| 3,921,358 A | | 11/1975 | Bettoli | |
| 4,233,100 A | | 11/1980 | Cunningham et al. | |
| 4,637,191 A | * | 1/1987 | Smith | 52/522 |
| 4,717,614 A | | 1/1988 | Bondoc et al. | |
| 5,102,487 A | | 4/1992 | Lamb | |
| 6,083,592 A | * | 7/2000 | Chich | 428/40.3 |
| 6,145,265 A | * | 11/2000 | Malarkey et al. | 52/555 |

FOREIGN PATENT DOCUMENTS

| | | |
|---|---|---|
| CA | 2 228 639 A | 8/1998 |
| WO | WO 00/49244 | 8/2000 |

* cited by examiner

*Primary Examiner*—Christopher A. Fiorilla
(74) *Attorney, Agent, or Firm*—Inger H. Eckert; James J. Dottavio

(57) ABSTRACT

A method of reducing humping of a laminated roofing shingle when the shingle is stacked with others of the shingle involves shingles that include a longitudinal central area having an overlay laminated with an underlay. The method involves providing a depression in the shingle that extends through at least a portion of the central area. In another embodiment, the invention is a method of reducing humping of a laminated roofing shingle including an overlay, an underlay, and an adhesive between the overlay and the underlay in an area of the shingle. The method involves providing a depression in the shingle that extends through at least a portion of the adhesive area. In a further embodiment, the invention is a method of reducing humping of a roofing shingle having a sealant in an area of the shingle. The method involves providing a depression in the shingle that extends through at least a portion of the sealant area.

21 Claims, 6 Drawing Sheets

REDUCING HUMPING OF ROOFING SHINGLES

TECHNICAL FIELD AND INDUSTRIAL APPLICABILITY OF THE INVENTION

This invention relates to roofing shingles, and more particularly to a method of reducing humping of roofing shingles.

BACKGROUND OF THE INVENTION

It is well known in the roofing industry that irregularity or variation in shingle design provides a roof that is aesthetically pleasing and in popular demand. Mass produced asphalt roofing shingles of the ordinary three-tab variety, when placed on the roof, result in a roof that sometimes appears flat, dimensionless and uninteresting. Shingle manufacturers have attempted to provide a better appearance to such roofs by using variations in the thickness and in the tab cutout design of shingles. The goal is to produce a random looking sequence or pattern of shingles on the roof, similar to the appearance given by a roof shingled with wood shingles having varying widths, lengths and thicknesses.

Innovations to improve the random-like character of shingles include the use of laminated shingles. A common type of laminated shingle consists of an overlay having tabs and cutouts in the exposed portion of the shingle, and an underlay adhered to the bottom of the overlay below the tabs and cutouts. The laminated shingle includes laminated or double-layered portions where the overlay and underlay overlap, and nonlaminated or single-layered portions where they do not overlap. The laminated portions include the areas of the tabs, and a longitudinal central area of the shingle between the inner ends of the cutouts and the inner end of the underlay. The nonlaminated portions include the areas of the cutouts, and the area of the shingle that does not include the underlay.

After manufacture, the laminated shingles are packaged in a stack or bundle of the shingles. The laminated shingles are often stacked by turning every other shingle 180° relative to the adjacent shingles. This stacking method minimizes uneven build in the bundle caused by the difference in thickness between the area of the shingle that includes the underlay and the area that does not include the underlay. However, a problem occurs along the central area of the bundle because the longitudinal central areas of the shingles are double-layered whereas the cutout areas of the shingles on the sides of the central areas are single-layered. The difference in thickness causes an unsightly hump or ridge along the central area of the bundle that becomes progressively higher as the number of shingles in the bundle is increased. When multiple shingle bundles are stacked on a pallet, the humps amplify themselves and can cause unsightly pallet build, instability of the stacked bundles, and high contact pressures at the intersections of the overlapping bundles. The high contact pressures can cause shingle deformation and sticking between individual shingles.

The difference in thickness of different portions of the laminated shingles is not the only cause of humping of the shingles. The overlay and underlay of the laminated shingle are usually joined together by several adhesive beads. The adhesive beads can cause humping of the shingles because of the thickness of the beads.

Further, the humping problem is not limited to laminated shingles. Both laminated shingles and single-layered ("three-tab") shingles often include a sealant bead on the top of the shingle to hold down the tabs of the adjacent shingle when the shingles are installed on a roof. The sealant beads can also cause humping of the shingles.

The prior art neither mentions the problem of humping nor suggests any method of reducing the problem. For example, U.S. Pat. No. 5,102,487 to Lamb, U.S. Pat. No. 4,233,100 to Cunningham et al., and U.S. Pat. No. 3,921,358 to Bettoli disclose laminated roofing shingles and methods of producing the shingles, but the patents do not address humping of the shingles.

U.S. Pat. No. 4,717,614 to Bondoc et al. discloses a laminated roofing shingle in which the asphalt coating is applied thicker on the tab portion of the overlay than the headlap portion of the overlay. The purpose of this structure is to accentuate the difference in thickness between the overlay and the underlay, in order to improve the appearance of the shingle on the roof. There is no suggestion of the problem of humping or any method of reducing the problem. Therefore, it would be desirable to provide a method of reducing humping of roofing shingles.

SUMMARY OF THE INVENTION

The above object as well as others not specifically enumerated are achieved by a method of reducing humping of a laminated roofing shingle when the shingle is stacked with others of the shingle. The shingle includes a longitudinal central area having an overlay laminated with an underlay. The method involves providing a depression in the shingle that extends through at least a portion of the central area.

In another embodiment, the invention is a method of reducing humping of a laminated roofing shingle including an overlay, an underlay, and an adhesive between the overlay and the underlay in an area of the shingle. The method involves providing a depression in the shingle that extends through at least a portion of the adhesive area.

In a further embodiment, the invention is a method of reducing humping of a roofing shingle having a sealant in an area of the shingle. The method involves providing a depression in the shingle that extends through at least a portion of the sealant area.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
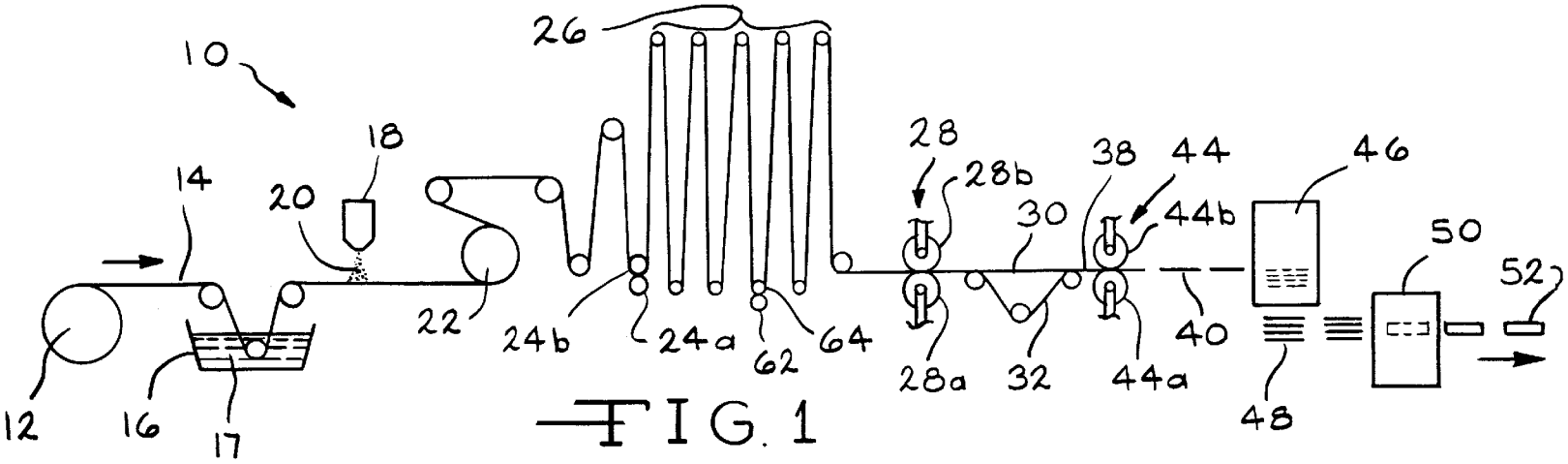
FIG. 1 is a schematic view in elevation of apparatus for manufacturing laminated roofing shingles having reduced humping, according to the principles of the invention.

Referring now to the drawings, there is shown in FIG. 1 an apparatus 10 for manufacturing laminated roofing shingles according to the invention. It is to be understood that, although the invention will be illustrated with reference to a particular type of laminated roofing shingle, the invention is also applicable to other types of laminated roofing shingles. Further, one embodiment of the invention is applicable to three-tab roofing shingles as well as laminated roofing shingles.

As shown in FIG. 1, a mat or substrate is payed out from a roll 12 as a continuous sheet 14. The mat can be any type of material known for use in reinforcing asphalt-based roofing materials, such as a web, scrim or felt of fibrous materials such as mineral fibers, cellulose fibers, rag fibers, mixtures of mineral and synthetic fibers, or the like. Preferably, the mat is a nonwoven web of glass fibers.

The sheet is passed through a coater 16 where an asphalt coating 17 is applied to the sheet. The asphalt coating can be applied in any suitable manner. In the illustrated embodiment, the sheet is submerged in a supply of hot, molten asphalt coating to completely cover the sheet with the tacky coating. However, in other embodiments, the asphalt coating could be sprayed on, rolled on, or applied to the sheet by other means.

The term "asphalt coating" means any type of material suitable for coating a roofing material, such as bituminous materials including asphalts, tars, pitches, or mixtures thereof. The asphalt can be either a manufactured asphalt produced by refining petroleum or a naturally occurring asphalt. The asphalt coating can include various additives and/or modifiers, such as inorganic fillers or mineral stabilizers, organic materials such as polymers, recycled streams, or ground tire rubber. Usually, the asphalt coating contains an asphalt and an inorganic filler or mineral stabilizer.

The hot asphalt coated sheet is passed beneath one or more granule applicators 18 that discharge protective surface granules 20 onto the top of the sheet. In the manufacture of colored shingles, two types of granules are typically employed. Headlap granules are granules of relatively low cost used for the portion of the shingle that will be covered up on the roof. Colored granules or prime granules are of relatively higher cost and are applied to the portion of the shingle that will be exposed on the roof. The shingles may have a background color and a series of granule deposits or blend drops of different colors or different shades of the background color.

The sheet is passed around a drum 22 that presses the granules into the hot, tacky asphalt coating and inverts the sheet sufficiently for any non-adhering granules to fall into a hopper (not shown) for recycling. The sheet is then passed between a pair of press rolls 24*a*, 24*b* that further press the granules into the sheet. Next, the sheet is passed through a conventional cooling section 26 in which it is passed up and down between a number of rolls and sprayed with water to cool the hot asphalt coating.

Figure 4:
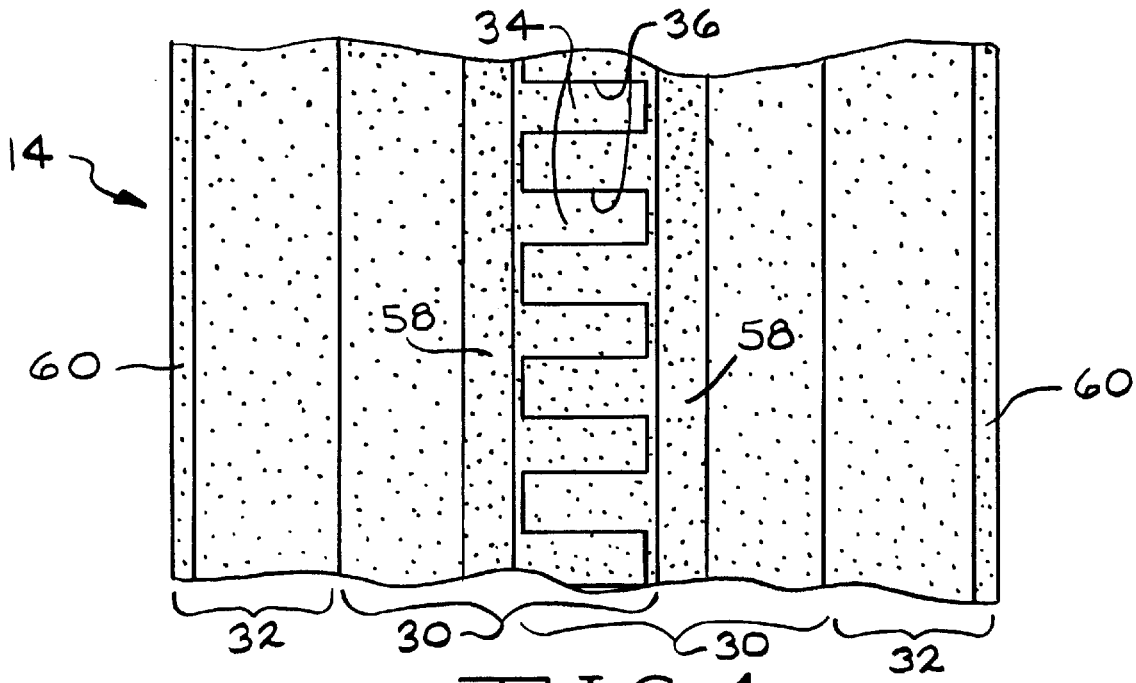
FIG. 4 is a top view of the sheet of roofing material after cutting it into overlay and underlay portions, showing the depressions formed in the overlay and underlay portions.

After the cooling process, the sheet is fed through a pattern cutter 28 consisting of a knife roll 28*a* and an anvil roll 28*b*. The knife roll engages the continuous sheet and divides it into continuous overlay strips 30 and underlay strips 32. FIG. 4 illustrates the sheet having been cut into overlay strips 30 and underlay strips 32. The overlay strips have a saw-tooth pattern of tabs 34 and cutouts 36 on one edge. The underlay strips are generally rectangular, and are slightly less than half as wide as the overlay strips. Suitable pattern cutters are well known in the art, for example, the cutter disclosed in U.S. Pat. No. 5,102,487 issued Apr. 7, 1992 to Lamb, incorporated by reference herein. The knife roll of the cutter has two straight blades that divide the underlay strips from the overlay strips, and a patterned blade that cuts the overlay strip into two continuous overlay strips having the pattern of tabs and cutouts.

Figure 5:
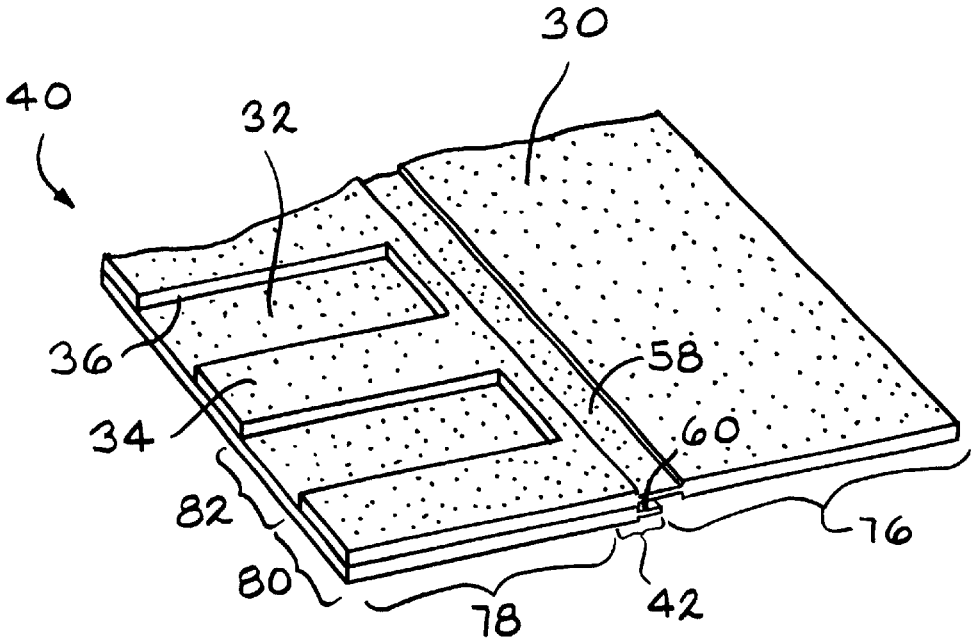
FIG. 5 is a perspective view of the overlay and underlay portions of the sheet joined and cut to produce a laminated roofing shingle, showing the depressions formed in the overlay and underlay of the shingle.

As shown in FIG. 1, the overlay strips 30 and underlay strips 32 are separated from each other. Then, the underlay strips are positioned beneath the overlay strips and joined together by means, not shown, to produce laminated strips 38. The means for joining the underlay and overlay strips are well known in the art, and could include, for example, guiding conveyor belts, an adhesive applicator, and means for pressing the underlay and overlay together. FIG. 5 illustrates a laminated roofing shingle 40 in which the underlay 32 is adhered to the bottom of the overlay 30 below the tabs 34 and cutouts 36. The overlay 30 and underlay 32 are typically joined together by three longitudinal beads of adhesive 88, 90 and 92 (shown in FIGS. 7 and 8), one adhesive bead 88 along the central area 42 of the shingle and two adhesive beads 90 and 92 along the tabs 34 of the shingle. The adhesive beads will be discussed in more detail below.

A bead of sealant 94 (shown on a three-tab shingle 96 in FIG. 12) is often applied on the top of the shingle to hold down the tabs of the adjacent shingle when the shingles are installed on a roof. The sealant can be any material suitable for this purpose, but it is typically an asphalt material such as the asphalt coating used to coat the shingles. The sealant bead is covered by a release tape (not shown) that is removed when the shingle is installed on the roof. The sealant bead will be discussed in more detail below.

As shown in FIG. 1, the laminated strips 38 are fed through a shingle cutter 44 consisting of a knife roll 44*a* and an anvil roll 44*b*. The knife roll has blades that engage the laminated strips and divide them into discrete laminated roofing shingles 40, such as the laminated roofing shingle 40 shown in FIG. 5. The shingle cutter can be any type suitable for cutting the laminated strips into individual shingles.

After the laminated roofing shingles are formed, they can be processed with commonly used apparatus for handling the shingles, such as a shingle stacker 46 to form stacks 48 of shingles, and a bundle packager 50 to form shingle bundles 52.

Figure 9:
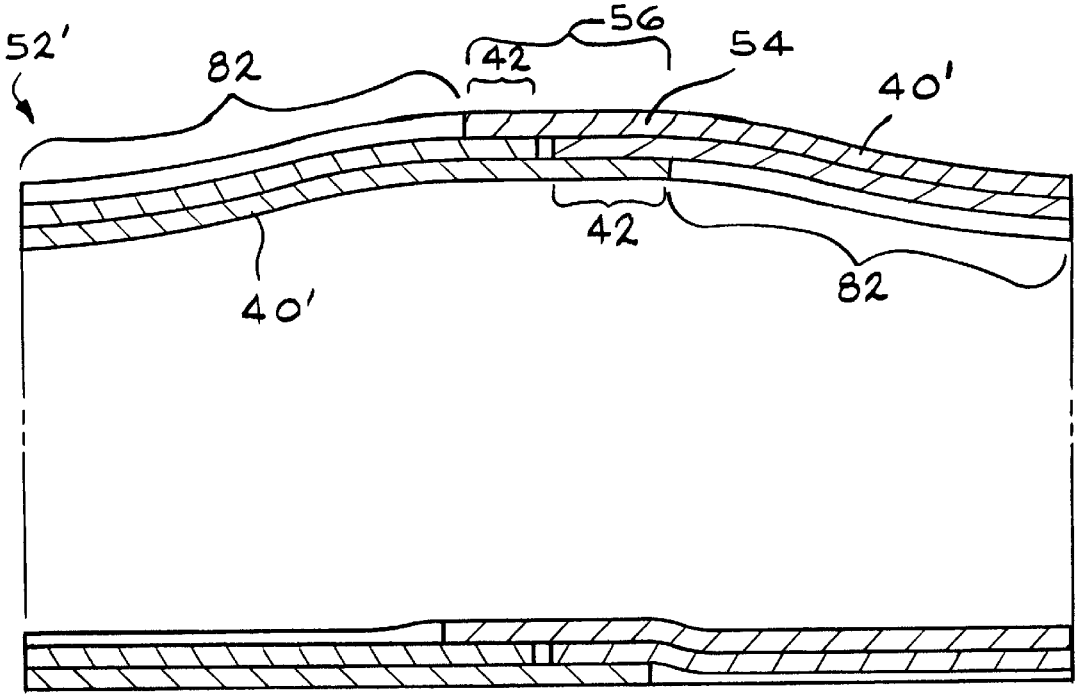
FIG. 9 PRIOR ART
FIG. 9 is a side cross-sectional view of a bundle of laminated roofing shingles of the prior art, showing humping of the bundle of shingles.

As described above, bundles of laminated roofing shingles produced by conventional methods have a hump or ridge along the central area of the bundle. FIG. 9 shows a bundle 52' of laminated roofing shingles of the prior art, showing a hump 54 along the central area 56 of the bundle. In contrast, the method of this invention produces laminated roofing shingles having reduced humping when the shingles are stacked in a bundle.

Figure 3:
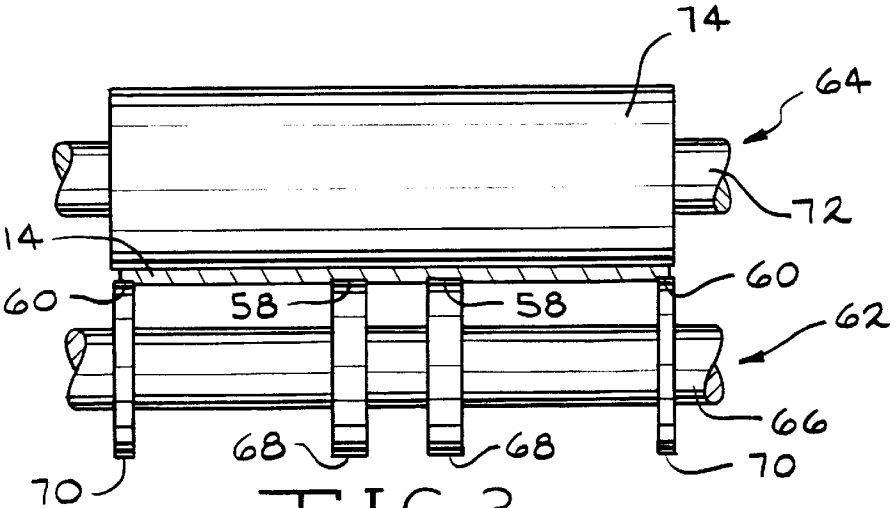
FIG. 3 is a front view in elevation of the rolls and the sheet of roofing material of FIG. 2.
Figure 2:
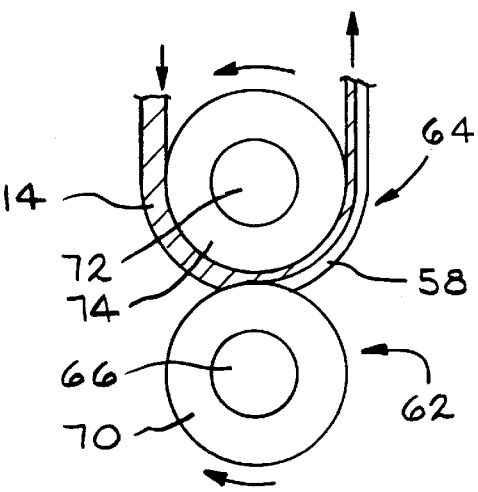
FIG. 2 is a side view in elevation of a pair of rolls of the apparatus of FIG. 1, showing the rolls pressing depressions in a sheet of roofing material.

As shown in FIGS. 1–3, the present method involves providing one or more depressions 58, 60 in the sheet 14 of roofing material. "Depression" means any groove, recess, indentation or similar structure suitable for reducing humping of the roofing shingle. The depression can be any size and shape suitable for reducing humping, such as a rectangular shape or an arcuate shape. The depression can be continuous or discontinuous. Preferably, the depression is a continuous longitudinal groove, as will be described below. As further described below, the depression can be provided in the overlay, the underlay, or both the overlay and underlay of a laminated shingle. The depression can be provided on one side of the sheet of roofing material (either the top or the bottom), or on both sides of the sheet. When the depression is positioned at a single location of the sheet on both the top and bottom of the sheet, it will be referred to hereinafter as a single depression having top and bottom portions.

The depressions can be provided by any suitable method, including tailoring the application of the asphalt coating to form depressions in the coating, or contacting the asphalt coating with a doctor blade or other device to form depressions in the coating. However, these methods are not preferred because they have various drawbacks. A preferred method of forming the depressions in the sheet of roofing material is a pressing operation, as shown in FIGS. 1–3. Any type of pressing equipment and process suitable for forming the depressions can be used in the invention.

The illustrated apparatus includes a specially designed press roll 62 that cooperates with an idler roll 64 to press depressions 58, 60 in the sheet. The depressions can be pressed in the sheet any time between the asphalt coating step and the packaging of the finished shingles. Preferably, the depressions are pressed in the sheet after the granules have been applied to the sheet and before the sheet is cut into the overlay and underlay strips. In the illustrated embodiment, the press roll 62 and the idler roll 64 are located in the cooling section 26 of the apparatus.

The illustrated press roll 62 includes an axle 66, two inner rings 68 fixed to the axle, and two outer rings 70 fixed to the axle. The idler roll 64 includes an axle 72 and a cylinder 74 fixed to the axle. In one embodiment of the invention, the cylinder 74 and the rings 68, 70 are about 10.5 inches in diameter, the inner rings 68 are about 2 inches wide, and the outer rings 70 are about 1 inch wide. The rings and the cylinder can be formed from any material suitable for use in the pressing operation. Preferably, the rings and the cylinder are formed of carbide steel or chrome-plated steel.

The sheet 14 is fed between the press roll 62 and the idler roll 64. The press roll and the idler roll are mounted so that they can be rotated on their axles for feeding the sheet therebetween, and pressed against each other to press the depressions in the sheet. In one embodiment of the invention, the press roll and the idler roll are mounted on arms (not shown) having a common pivot. The arms can be actuated to move toward each other under pressure, such as by pneumatic or hydraulic means. The arms are controlled by any suitable means, such as a computer. The pressure on the sheet between the rings 68, 70 of the press roll 62 and the cylinder 74 of the idler roll 64 forms the depressions 58, 60 in the sheet.

As shown in FIG. 4, the sheet 14 of roofing material is cut into a pair of overlay portions 30 and a pair of underlay portions 32. The method of the invention involves providing a depression in at least one of the overlay portion and the underlay portion of the sheet. Preferably, depressions are provided in both the overlay portion and the underlay portion of the sheet. In the illustrated embodiment, the inner rings of the press roll form overlay depressions 58 in the overlay portions 30 of the sheet. The overlay depressions are preferably continuous longitudinal grooves. Preferably, the overlay depressions 58 are spaced inward a short distance from the inner ends of the cutouts 36 to ensure that the depressions are not visible in the exposed portion of the shingle when the shingle is installed on a roof. The outer rings of the press roll form underlay depressions 60 in the underlay portions 32 of the sheet, along the opposing edges of the sheet. The underlay depressions are preferably continuous longitudinal grooves.

Preferably, the depressions have a width within the range of from about 0.5 inch (1.27 centimeters) to about 2.5 inches (6.35 centimeters). In the embodiment shown, the overlay depressions 58 are approximately twice as wide as the underlay depressions 60, because of the difference in width of the inner rings 68 and the outer rings 70 of the press roll 62. In a particular embodiment, the overlay depressions have a width within the range of from about 1 inch (2.54 centimeters) to about 2.5 inches (6.35 centimeters), and the underlay depressions have a width within the range of from about 0.5 inch (1.27 centimeters) to about 1 inch (2.54 centimeters).

In the embodiment shown in FIG. 5, the overlay depression 58 and the underlay depression 60 are positioned so that they cooperate with each other when the overlay 30 and underlay 32 are joined together in the laminated shingle 40. The shingle includes a longitudinal central area 42 between the inner ends of the cutouts 36 and the inner end of the underlay 32. In the central area 42, the overlay 30 is continuously laminated with the underlay 32, so that the central area is a relatively thick area of the shingle. The width of the central area will vary depending on the design of the shingle. In a particular embodiment, the shingle is about 13¼ inches (33.6 centimeters) wide, the underlay is about 6½ inches (16.5 centimeters) wide, the cutout is about 5⅝ inches (14.3 centimeters) wide, and the central area is about ⅞ inch (2.2 centimeters) wide. The shingle includes a headlap area 76 on one side of the central area 42.

The headlap area 76 is a single-layered area of the shingle, consisting solely of the overlay 30. Thus, the headlap area is relatively thin compared to the laminated central area of the shingle. The shingle includes a prime area 78 on the other side of the central area 42. The prime area 78 includes tab portions 80 in the areas of the tabs 34, and cutout portions 82 in the areas of the cutouts 36. The tab portions consist of overlay 30 laminated to underlay 32, but the cutout portions 82 are single-layered, consisting solely of the underlay 32. Thus, the cutout portions 82 are relatively thin compared to the laminated central area 42 of the shingle. The locations of the cutout portions vary in different shingles, so that when the shingles are stacked in a bundle, the prime areas 78 of the shingles are relatively thin on average compared to the central areas 42 of the shingles.

To be effective for reducing humping of the laminated shingles, the depression extends through at least a portion of the central area 42. Preferably, the depression extends through at least about 50% (as measured by area percentage) of the central area. In the illustrated embodiment, each of the overlay depression 58 and the underlay depression 60 extends through about 50% of the central area 42. The overlay depression 58 is located approximately one-half inside the central area 42 and one-half inside the headlap area 76, while the underlay depression 60 is located completely inside the central area 42.

Figure 6:
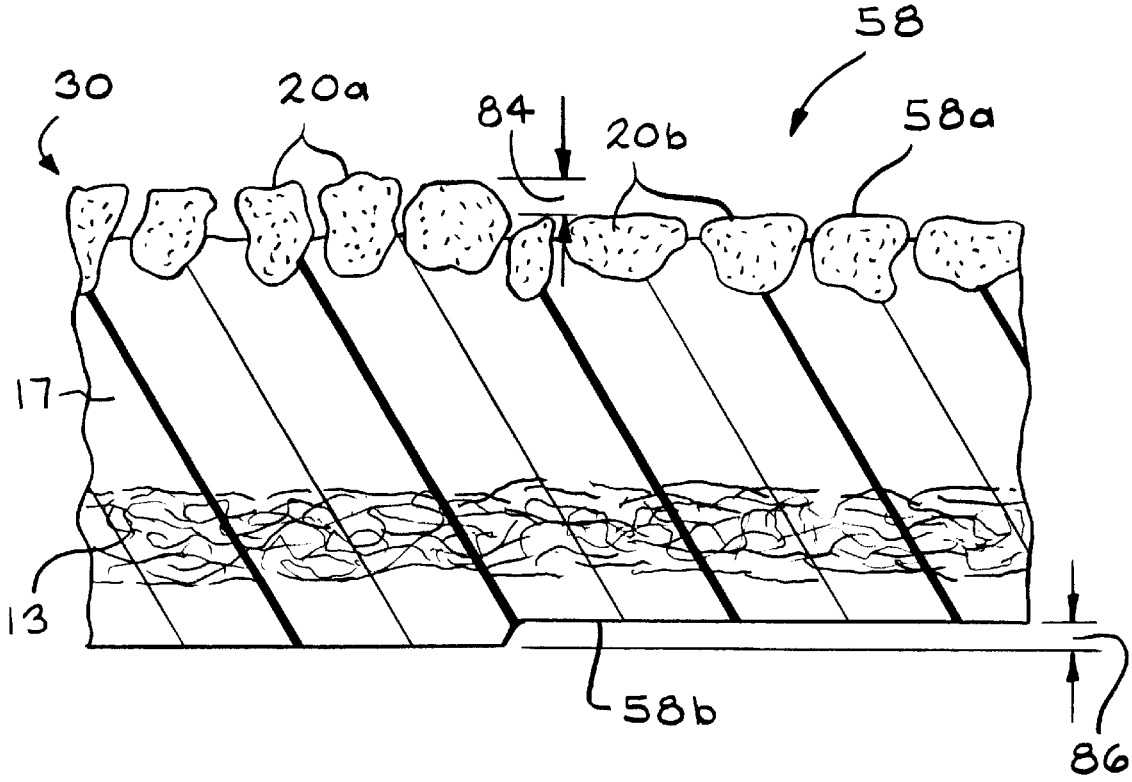
FIG. 6 is an enlarged cross-sectional view of part of the overlay of the laminated shingle of FIG. 5, showing the depression formed in the top and bottom of the overlay.

FIG. 6 is an enlarged cross-sectional view of part of the overlay 30 of the shingle of FIG. 5, showing the overlay depression 58 provided in the overlay.

The overlay includes a mat 13 coated with asphalt coating 17 and surfaced with granules 20*a*, 20*b*. The illustrated overlay depression 58 includes a top portion 58*a* formed in the granule side (the top side) of the overlay, and a bottom portion 58*b* formed in the asphalt side (the bottom side) of the overlay. Although the rings 68, 70 of the press roll 62 shown in FIG. 3 press against the asphalt side of the sheet 14, the resulting pressure between the rings and the cylinder 74 forms depressions in both the asphalt side and the granule side of the sheet. However, as discussed above, the depression can also be provided on just one side of the sheet (either the granule side or the asphalt side).

The depressions can be provided with any depth suitable for reducing humping of the shingles. Preferably, the depressions have a depth within the range of from about 0.002 inch (0.005 centimeter) to about 0.015 inch (0.038 centimeter), and more preferably from about 0.005 inch (0.013 centimeter) to about 0.015 inch (0.038 centimeter). As shown in FIG. 6, the "depth" of the depression 58 includes the depth 84 of the top portion 58*a* of the depression combined with the depth 86 of the bottom portion 58*b* of the depression.

Preferably, the depression is provided primarily by pressing the granules into the asphalt coating. As shown in FIG. 6, the granules 20*b* inside the depression 58 are pressed further into the asphalt coating 17 than the granules 20*a* outside the depression. The flat surfaces of the granules also tend to align with the ring of the press roll, parallel to the sheet. On the asphalt side of the overlay, the depression is present as a slight impression in the overlay. Preferably, at least about 65% of the thinning of the sheet of roofing material occurs by pressing the granules into the asphalt coating. It is less desirable to provide the depression by moving the asphalt coating, because the amount of pressure needed is considerably greater, resulting in increased wear on the equipment and the possibility of damaging the sheet of roofing material. Preferably, the method causes no damage either to the mat or to the asphalt coating of the sheet, e.g., by causing tears in the mat or cracks in the asphalt coating.

The asphalt coating usually is applied to the sheet at a temperature between about 375° F. (191° C.) and 425° F. (218° C.). Preferably, the depressions are pressed in the sheet when the asphalt coating is still hot, at a temperature within the range of from about 130° F. (54° C.) to about 325° F. (163° C.), and more preferably from about 150° F. (66° C.) to about 250° F. (121° C.). Hotter temperatures may cause sticking of the asphalt coating to the rings of the press roll, as well as other process problems. Cooler temperatures require significantly higher pressures that would cause wear on the equipment and that may not be practical in a commercial shingle-making process. In an alternate embodiment, the asphalt coating could be cooled but then reheated by any suitable means prior to the pressing step, at least in the areas of the sheet where the depressions are to be pressed.

Preferably, the depressions are pressed in the sheet at a pressure within the range of from about 25 pounds per lineal inch of press (4.5 kilograms per lineal centimeter of press) to about 150 pounds per lineal inch of press (26.8 kilograms per lineal centimeter of press). (The pressure is given in pounds per lineal inch because the rings of the press roll and the cylinder of the idler roll make line to line contact during the pressing operation.) A pressure under about 25 pounds per lineal inch of press (4.5 kilograms per lineal centimeter of press) is not usually effective to form the depressions unless the asphalt coating is very hot. A pressure above about 150 pounds per lineal inch of press (26.8 kilograms per lineal centimeter of press) may damage the sheet of roofing material.

Figure 7:
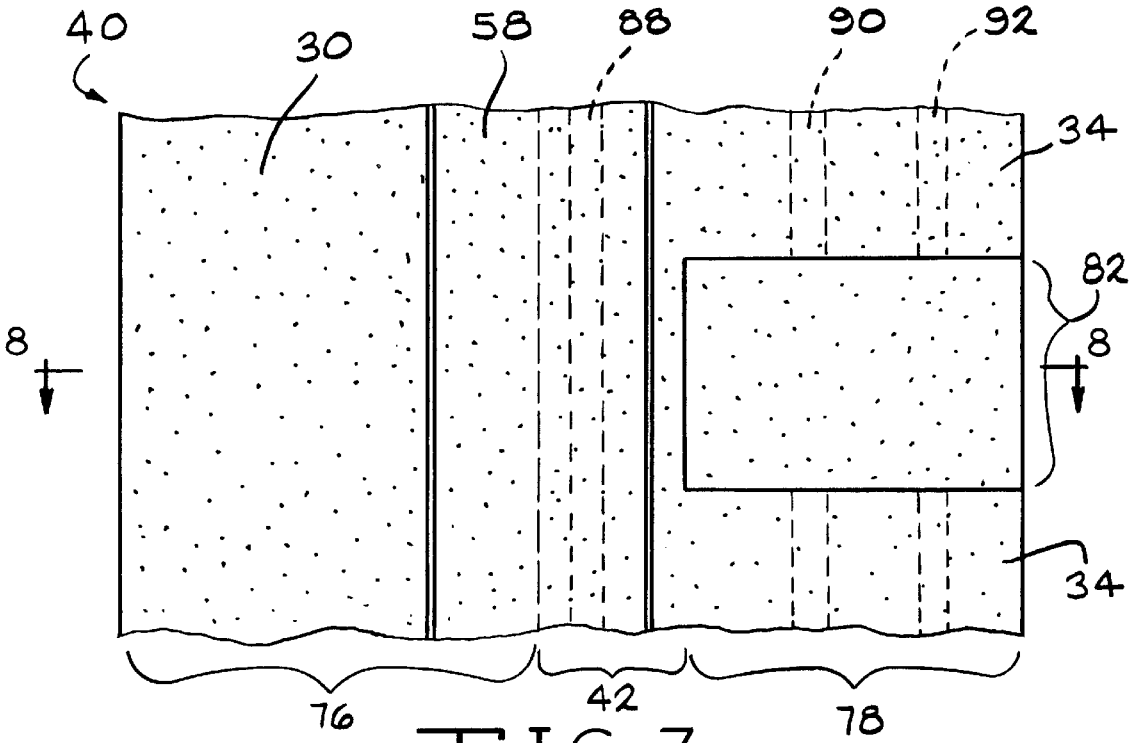
FIG. 7 is a top view of a portion of the laminated roofing shingle of FIG. 5.
Figure 8:
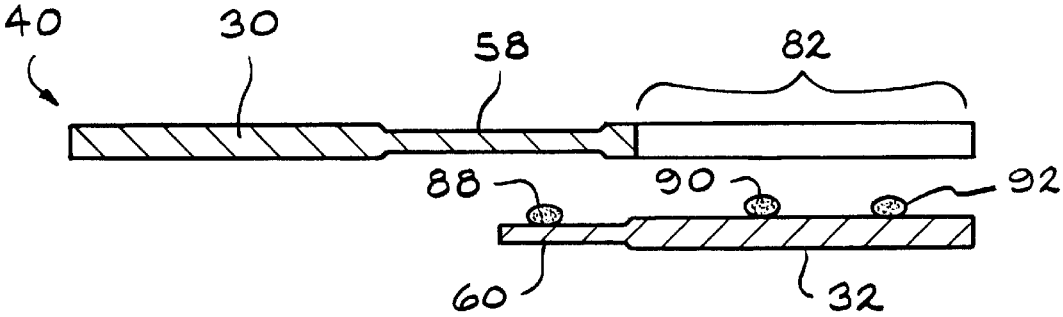
FIG. 8 is a side cross-sectional view taken along line 8—8 of FIG. 7, with the overlay shown separate from the underlay to better illustrate the depressions in the overlay and underlay.

FIGS. 7–11 illustrate the reduction in humping provided by the laminated roofing shingles of the invention, compared to laminated roofing shingles of the prior art. As shown in FIGS. 7 and 8, the laminated roofing shingle 40 of the invention includes an overlay 30 having an overlay depression 58, and an underlay 32 having an underlay depression 60. (The overlay and underlay are shown separated in FIG. 8 to better illustrate the overlay and underlay depressions). The shingle includes a longitudinal central area 42 between the inner end of the cutout 36 and the inner end of the underlay, a headlap area 76 on one side of the central area, and a prime area 78 on the other side of the central area. The prime area includes a cutout portion 82.

Figure 10:
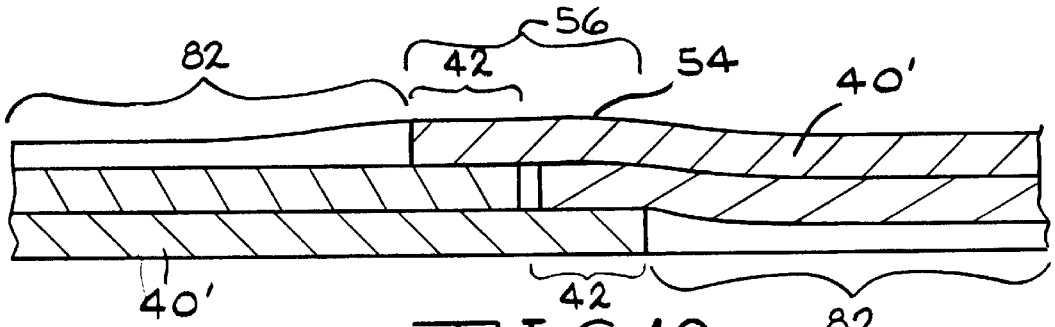
FIG. 10 PRIOR ART
FIG. 10 is a side cross-sectional view of a pair of laminated roofing shingles of the prior art stacked together, shown in exaggerated thickness to illustrate humping of the stacked shingles.

As shown in FIGS. 9 and 10, laminated roofing shingles 40' of the prior art are stacked in a bundle 52' with every other shingle inverted and turned 180°. This stacking method minimizes uneven build in the bundle caused by the difference in thickness between the area of the shingle that includes the underlay and the area that does not include the underlay. However, a problem occurs along the central area 56 of the bundle because the central areas 42 of the shingles are double-layered whereas the cutout portions 82 of the shingles on the sides of the central areas are single-layered. The difference in thickness causes a hump 54 or ridge along the central area 56 of the bundle that becomes progressively higher as the number of shingles in the bundle is increased.

Figure 11:
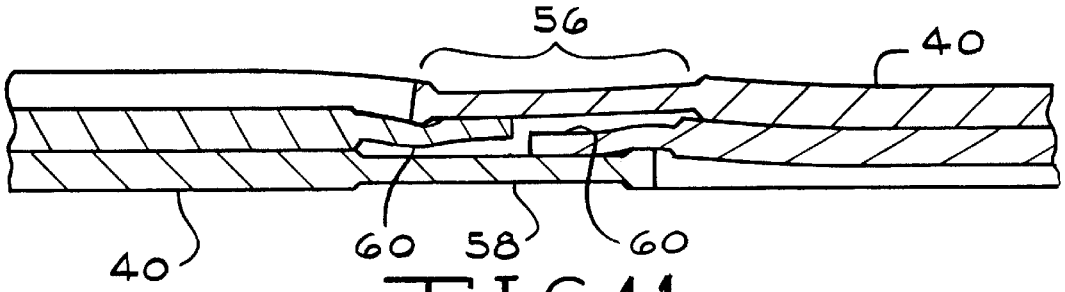
FIG. 11 is a side cross-sectional view of a pair of laminated roofing shingles according to the invention stacked together, shown in exaggerated thickness to illustrate how the overlay and underlay depressions of the shingles cooperate to reduce humping of the stacked shingles.

As shown in FIG. 11, in contrast to the prior art shingles, when the laminated shingles 40 of the invention are stacked, the overlay depressions 58 and the underlay depressions 60 of the shingles cooperate to reducing humping in the central area 56 of the bundle. Additionally, the laminated shingles 40 are formed such that the underlay depression 60 and the overlay depression 58 are aligned as clearly shown in FIGS. 8 and 11.

As further shown in FIG. 11, when the laminated shingles 40 of the invention are stacked in a bundle, the bundle includes a plurality of pairs of the laminated shingles 40. Each underlay 32 of one laminated shingle 40 of each pair of shingles is facing the bottom of the overlay 30 of the other laminated shingle 40 of the pair of shingles.

As discussed above, the overlay and underlay of the laminated shingle are usually joined together by adhesive, typically in the form of several adhesive beads. FIGS. 7 and 8 show the overlay 30 and underlay 32 joined together by three longitudinal adhesive beads: one adhesive bead 88 along the central area 42 of the shingle and two adhesive beads 90 and 92 along the tabs 34 of the shingle. The adhesive can cause humping of the shingle because of the added thickness of the adhesive. Accordingly, another embodiment of the invention is a method of reducing humping of a laminated roofing shingle including an overlay, an underlay, and an adhesive between the overlay and the underlay in an area of the shingle. The method involves providing a depression in the shingle that extends through at least a portion of the adhesive area. Preferably, the depression extends through at least about 50% (as measured by area percentage) of the adhesive area. The "adhesive area" means any area of the shingle where adhesive has been applied in any form. In the embodiment shown in FIGS. 7 and 8, each of the overlay depression 58 and the underlay depression 60 extends across the entire area of the adhesive bead 88 extending along the central area 42 of the shingle.

Figure 12:
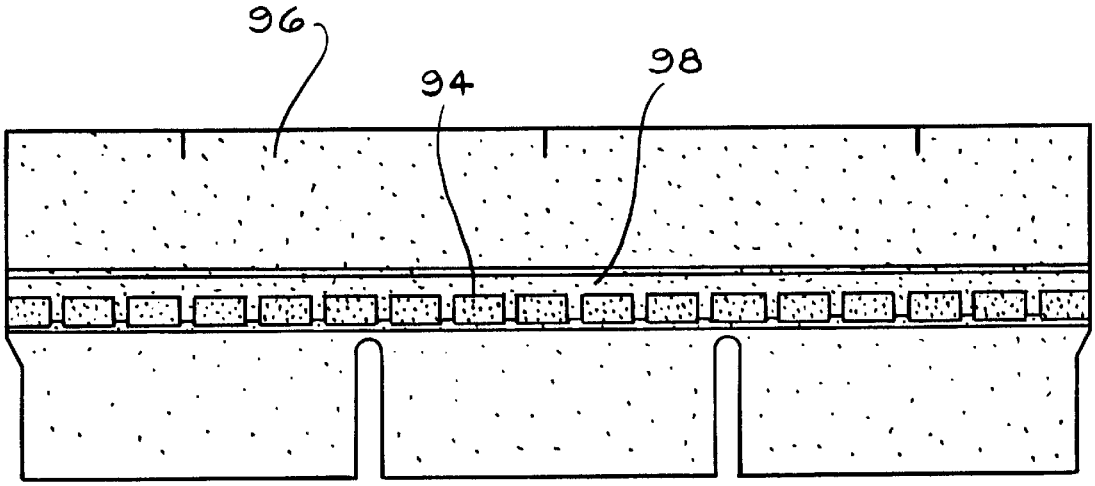
FIG. 12 is a plan view of a three-tab shingle having a sealant bead and a depression located in the area of the sealant bead, according to another embodiment of the invention.

As further discussed above, both laminated shingles and three-tab shingles often include a sealant on the top of the shingle to hold down the tabs of the adjacent shingle when the shingles are installed on a roof. The sealant is typically applied in the form of a sealant bead. FIG. 12 shows a three-tab shingle 96 having a longitudinal sealant bead 94. The sealant bead can cause humping of the shingle. Accordingly, a further embodiment of the invention is a method of reducing humping of a roofing shingle having a sealant in an area of the shingle. The method involves providing a depression in the shingle that extends through at least a portion of the sealant area. Preferably, the depression extends through at least about 50% of the sealant area. The "sealant area" means any area of the shingle where sealant has been applied in any form. In the embodiment shown in FIG. 12, a continuous longitudinal depression 98 is provided that extends across the entire area of the sealant.

It is to be understood that, although the first embodiment of the invention has been illustrated primarily with respect to humping of laminated shingles when they are stacked in a bundle, the invention is not limited to humping in a bundle of shingles, but instead relates to any humping of the shingles. The stacking of shingles in a bundle has been illustrated with the shingles alternating face to face, and back to back, but the shingles can be stacked in any suitable manner (e.g., in a bundle with all the shingles facing upward and every other shingle turned 180°).

Further, although the illustrated first embodiment of the invention includes the press roll near the beginning of the cooling section of the apparatus, the pressing can be done at other locations in the manufacturing process. For example, the conventional press roll in the apparatus could be modified to press longitudinal grooves in the sheet.

The principle and mode of operation of this invention have been described in its preferred embodiments. However, it should be noted that this invention may be practiced otherwise than as specifically illustrated and described without departing from its scope.

What is claimed is:

1. A method of reducing humping of a laminated roofing shingle when the shingle is stacked with others of the shingle, each laminated roofing shingle including a shingle overlay having a plurality of spaced apart tabs defining cutouts therebetween, and a generally uniform thickness, each cutout having an inner end, and a shingle underlay having a generally uniform thickness, and an inner end, the method comprising:

providing the shingle overlay and the shingle underlay;

forming a longitudinal depression at the inner end of the shingle underlay and forming a longitudinal depression inwardly of the inner end of the cutout of the shingle overlay, and laminating the shingle underlay to the shingle overlay to form the laminated roofing shingle such that the underlay depression and the overlay depression are aligned.

2. The method defined in claim 1 wherein the step of providing the depression comprises providing depressions in both the overlay and the underlay.

3. The method defined in claim 1 wherein the depression extends through at least about 50% of the central area.

4. The method defined in claim 1 wherein the shingle includes an asphalt coating, and wherein the depression is provided by a pressing step when the asphalt coating is at a temperature within the range of from about 130° F. (54° C.) to about 325° F. (163° C.).

5. The method defined in claim 4 wherein the shingle includes a layer of granules on the asphalt coating, and wherein the pressing step provides the depression primarily by pressing the granules into the asphalt coating.

6. The method defined in claim 1 wherein the step of providing the depression comprises providing depressions in both the overlay and the underlay, wherein the shingle includes an asphalt coating, and wherein the depressions are provided by a pressing step when the asphalt coating is at a temperature within the range of from about 130° F. (54° C.) to about 325° F. (163° C.).

7. The method defined in claim 6 wherein the pressing step provides depressions having a depth within the range of from about 0.002 inch (0.005 centimeter) to about 0.015 inch (0.038 centimeter).

8. The method defined in claim 6 wherein the pressing step provides depressions having a width within the range of from about 0.5 inch (1.27 centimeters) to about 2.5 inches (6.35 centimeters).

9. The method defined in claim 6 wherein the pressing step is conducted at a pressure within the range of from about 25 pounds per lineal inch of press (4.5 kilograms per lineal centimeter of press) to about 150 pounds per lineal inch of press (26.8 kilograms per lineal centimeter of press).

10. The method defined in claim 1 including stacking the laminated roofing shingles in a bundle, the bundle including a plurality of pairs of the laminated roofing shingles, each underlay of one laminated roofing shingle of each pair of shingles facing the bottom of the overlay of tie other laminated roofing shingle of the pair of shingles.

11. A method of reducing humping of a laminated roofing shingle when the shingle is stacked with others of the shingle, each laminated roofing shingle including a shingle overlay having a plurality of spaced apart tabs defining cutouts therebetween, a generally uniform thickness, and a longitudinal central area at an inner end of each cutout, and a shingle underlay having a generally uniform thickness, and a longitudinal central area at an inner end of the underlay, wherein the inner end of each cutout of the shingle overlay and the inner end of the shingle underlay further define a longitudinal central area of the laminated roofing shingle, the method comprising:

providing the shingle overlay and the shingle underlay;

forming a longitudinal depression through at least one of the longitudinal central area of the shingle overlay and the longitudinal central area of the shingle underlay; and laminating the shingle underlay to the shingle overlay to form the laminated roofing shingle such that the longitudinal central area of the overlay and the longitudinal central area of the underlay are aligned;

wherein the shingle includes an asphalt coating, and wherein the depression is provided by a pressing step when the asphalt coating is at a temperature within the range of from about 130° F. (54° C.) to about 325° F. (163° C.).

12. The method defined in claim 11 wherein the shingle includes a layer of granules on the asphalt coating, and wherein the pressing step provides the depression primarily by pressing the granules into the asphalt coating.

13. A method of reducing humping of a roofing shingle having a sealant in an area of the shingle, the method comprising providing a depression in the shingle that extends through at least a portion of the sealant area, the shingle including an asphalt coating, and wherein the depression is provided by a pressing step when the asphalt coating is at a temperature within the range of from, about 130° F. (54° C.) to about 325° F. (163° C.).

14. The method defined in claim 13 wherein the shingle includes a layer of granules on the asphalt coating, and, wherein the pressing step provides the depression primarily by pressing the granules into the asphalt coating.

15. A method of reducing humping of a laminated roofing shingle when the shingle is stacked with others of the shingle, each laminated roofing shingle including a shingle overlay having a plurality of spaced apart tabs defining cutouts therebetween, a generally uniform thickness, and a longitudinal central area at an inner end of each cutout, and a shingle underlay having a generally uniform thickness, and a longitudinal central area at an inner end of the underlay, wherein the inner end of each cutout of the shingle overlay and the inner end of the shingle underlay further define a longitudinal central area of the laminated roofing shingle, the method comprising:

providing the shingle overlay and the shingle underlay;

forming a longitudinal depression through at least one of the longitudinal central area of the shingle overlay and the longitudinal central area of the shingle underlay;

laminating the shingle underlay to the shingle overlay to form the laminated roofing shingle such, that the longitudinal central: area of the overlay and the longitudinal central area of the underlay are aligned; and stacking the laminated roofing shingles in a bundle, the bundle including a plurality of pairs of the laminated roofing shingles, each underlay of one laminated roofing shingle of each pair of shingles facing the bottom of the overlay of the other laminated roofing shingle of the pair of shingles.

16. The method defined in claim 15 wherein an adhesive area is provided between the shingle overlay and the shingle underlay, the depression extending through at least about 50% of the adhesive area.

17. A method of reducing humping of a laminated roofing shingle when the shingle is stacked with others of the shingle, each laminated roofing shingle including a shingle overlay having a plurality of spaced apart tabs defining cutouts therebetween, a generally uniform thickness, and a longitudinal central area at an inner end of each cutout, and a shingle underlay having a generally uniform thickness, and a longitudinal central area at an inner end of the underlay, wherein the inner end of each cutout of the shingle overlay and the inner end of the shingle underlay further define a longitudinal central area of the laminated roofing shingle, the method comprising:

providing the shingle overlay and the shingle underlay;

forming a longitudinal depression through at least one of the longitudinal central area of the shingle overlay and the longitudinal central area of the shingle underlay;

applying a bead of adhesive in the depression; and laminating the shingle underlay to the shingle overlay to form the laminated roofing shingle such that the longitudinal central area of the overlay and the longitudinal central area of the underlay are aligned.

18. The method defined in claim 17 including contacting each of the overlay and underlay with the bead of adhesive during the step of laminating the shingle.

19. A method of reducing humping of a laminated roofing shingle when the shingle is stacked with others of the shingle, each laminated roofing shingle including a shingle overlay having a longitudinal central area, and a shingle underlay having a longitudinal central area at an inner end of the underlay, the method comprising:

providing the shingle overlay and the shingle underlay;

forming a longitudinal depression in the longitudinal central area of a bottom surface of the shingle overlay; and laminating the shingle underlay to the shingle overlay to form the laminated roofing shingle such that the longitudinal central area of the overlay and the longitudinal central area of the underlay are aligned.

20. A method of reducing humping of a laminated roofing shingle when the shingle is stacked with others of the shingle, each laminated roofing shingle including a shingle overlay having a longitudinal central area, and a shingle underlay having a longitudinal central area at an inner end of the underlay, the method comprising:

providing the shingle overlay and the shingle underlay;

forming a longitudinal depression through at least one of the longitudinal central area of a top surface of the shingle overlay and the longitudinal central area of a bottom surface of the shingle overlay;

laminating the shingle underlay to the shingle overlay to form the laminated roofing shingle such that the longitudinal central area of the overlay and the longitudinal central area of the underlay are aligned; and providing an adhesive on the longitudinal central area of one of the underlay and overlay, wherein the adhesive is aligned with the depression after lamination of the shingle.

21. A method of reducing humping of a laminated roofing shingle when the shingle is stacked with others of the shingle, each laminated roofing shingle including a shingle overlay having a plurality of spaced apart tabs defining cutouts therebetween, a generally uniform thickness, and a longitudinal central area at an inner end of each cutout, and a shingle underlay having a generally uniform thickness, and a longitudinal central area at an inner end of the underlay, wherein the inner end of each cutout of the shingle overlay and the inner end of the shingle underlay further define a longitudinal central area of the laminated roofing shingle, the method comprising:

providing the shingle overlay and the shingle underlay;

forming a longitudinal depression through the longitudinal central area of the shingle overlay and forming a longitudinal depression through the longitudinal central area of the shingle underlay; and laminating the shingle underlay to the shingle overlay to form the laminated roofing shingle such that the longitudinal central area of the overlay and the longitudinal central area of the underlay are aligned.

* * * * *